United States Patent [19]

Ona et al.

[11] Patent Number: 4,902,739

[45] Date of Patent: Feb. 20, 1990

[54] FIBER-TREATMENT COMPOSITION

[75] Inventors: Isao Ona; Masaru Ozaki, both of Chiba, Japan

[73] Assignee: Toray Silicone Company, Ltd., Tokyo, Japan

[21] Appl. No.: 195,983

[22] Filed: May 19, 1988

[30] Foreign Application Priority Data

May 26, 1987 [JP] Japan ..... 62-129399

[51] Int. Cl.[4] ..... C08L 23/06

[52] U.S. Cl. ..... 524/588; 549/215; 428/391; 528/12; 528/17; 528/18; 528/19; 528/21; 528/33; 528/34; 528/40; 427/387

[58] Field of Search ..... 549/215; 428/391; 528/12, 40, 33, 34, 19, 18, 17, 21; 427/387; 524/588

[56] References Cited

U.S. PATENT DOCUMENTS

| | | | |
|---|---|---|---|
| 3,655,420 | 4/1972 | Tichenor | 428/391 |
| 4,033,924 | 7/1977 | Katsutoshi et al. | 260/37 |
| 4,082,726 | 4/1978 | Mine et al. | 549/215 |
| 4,228,054 | 10/1980 | Ona et al. | 260/29.2 M |
| 4,661,405 | 4/1987 | Greene | 428/391 |

*Primary Examiner*—Melvyn I. Marquis

*Attorney, Agent, or Firm*—George A. Grindahl

[57] ABSTRACT

An organopolysiloxane with contains alkoxy radicals and epoxy-containing radicals on its molecular terminals has been found to be useful for treating fibers to provide a durable softness and flexibility, smoothness, wrinkle resistance, or rebound to fibrous material. The organopolysiloxane is substantially free of oligomers so that, during drying in the fiber treatment process, oil does not collect on exhaust fans and drip onto the treated material, causing oily spots.

3 Claims, No Drawings

FIBER-TREATMENT COMPOSITION

BACKGROUND OF THE INVENTION

The present invention relates to a fiber-treatment composition. Various treatment compositions prepared from organopolysiloxanes and their compositions have been used in the art in order to impart softness and flexibility, smoothness, wrinkle resistance, and rebound, among other properties, to fibrous materials such as natural fibers like cotton, flax, silk, wool, angora, and mohair; regenerated fibers such as rayon and Bemberg; semisynthetic fibers such as acetate; and synthetic fibers such as polyester, polyamide, polyacrylonitrile, polyvinyl chloride, vinylon, polyethylene, polypropylene, spandex, etc.

For example, Japanese Patent Application Laid Open (Kokai) Number 54-131661 (131,661/79) describes an organopolysiloxane latex composition which is prepared by the emulsion polymerization of cyclic organopolysiloxane with epoxy group-containing organotrialkoxysilane in water in the presence of a sulfonic acid surfactant or quaternary ammonium surfactant.

However, because the alkoxy radicals in the epoxy-containing organotrialkoxysilane are condensed or converted into hydroxyl radicals during emulsion polymerization, such a latex composition cannot impart a durable softness and flexibility, smoothness, wrinkle resistance, or rebound to fibrous material.

Also, as a consequence of the emulsion polymerization of siloxane cyclics, such a latex composition invariably contains 5 to 15% oligomer. This oligomer adheres to, for example, the exhaust fan during drying in the fiber treatment process, resulting in oily stains. Also, this oil can drip onto the fibrous material, generating oils spots.

BRIEF SUMMARY OF THE INVENTION

The object of the present invention is to solve the above-described problems by providing a fiber-treatment composition which can impart a durable softness and flexibility, smoothness, and rebound and which contains very little oligomer.

DETAILED DESCRIPTION OF THE INVENTION

The aforesaid object can be achieved by means of a fiber-treatment composition comprising an epoxy group-containing organopolysiloxane with the general structural formula

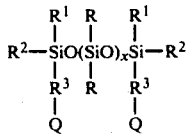

wherein R is a monovalent hydrocarbon radical, $R^1$ is an alkoxy radical, $R^2$ is an R or $R^1$ radical, $R^3$ is a divalent hydrocarbon radical, Q is a radical having the formula

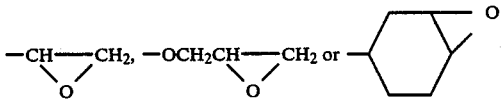

and x is an integer with a value of at least 5.

To explain the preceding, the epoxy group-containing organopolysiloxane with the general structural formula

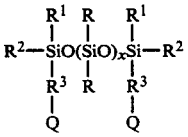

functions to impart a durable softness and flexibility, smoothness, wrinkle resistance, and rebound to fibrous material. In particular, because it has reactive functional radicals (alkoxy and epoxy) at both terminals in the molecular structure, it becomes strongly fixed and bonded to fibrous material. Furthermore, due to the presence of reactive functional radicals at both terminals, it is fixed and bonded to fibrous material in an inverted-U configuration, and as a consequence it generates an excellent softness and flexibility, smoothness, wrinkle resistance, and rebound due to the high degree of freedom on the part of the diorganopolysiloxane units.

In the above formula R is any monovalent hydrocarbon radical, and is exemplified by alkly radicals such as methyl, ethyl, propyl, and butyl; by substituted alkyl radicals such as 2-phenylethyl, 2-phenylpropyl, and 3,3,3-trifluoropropyl; by alkenyl radicals such as vinyl and propenyl; and by aryl and substituted aryl radicals such as phenyl and tolyl. The R radicals in the single molecule may be identical or different. Preferably all R radicals in the epoxy group containing organopolysiloxane are methyl radicals.

The $R^1$ radical is an alkoxy radical, and is exemplified by methoxy, ethoxy, isopropoxy, n-butoxy, and methoxyethoxy. Preferably all $R^1$ radicals in the epoxy group-containing organopolysiloxane are methoxy radicals.

The $R^2$ is an R or $R^1$ radical. The $R^3$ is a divalent hydrocarbon radical, and is exemplified by methylene, n-propylene, n-butylene, isopropylene, and phenylene.

The Q radical in the above formula is selected from the group consisting of

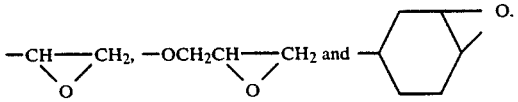

In the formula x is to be an integer with a value of at least 5. When x is less than 5, the organopolysiloxane cannot assume an inverted-U configuraiton on the fibrous material, which causes the softness and flexibility, smoothness, wrinkle resistance, and rebound to be unsatisfactory. It is preferred that the value of x be 5 to 1,000 and more preferably 7 to 500.

Concrete examples of the epoxy-containing organopolysiloxane under consideration are as follows.

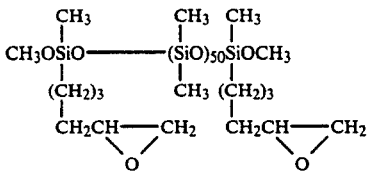

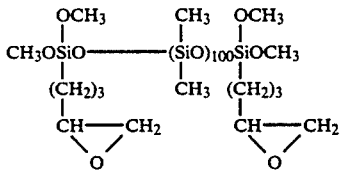

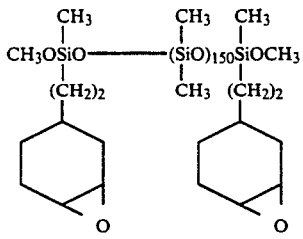

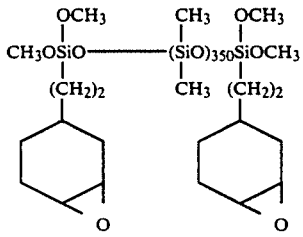

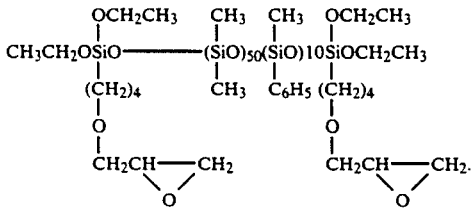

Such organopolysiloxanes may be readily prepared, for example, the reaction of a silanol-terminated diorganopolysiloxane with an epoxy group-containing organodialkoxysilane or epoxy group-containing organopolysiloxanetrialkoxysilane at 100 to 120 degrees Centigrade for 4 to 5 hours in the presence of a trace quantity of catalyst, for example, acetic acid, followed by removal of the acetic acid and alcohol by-product under reduced pressure.

As desired, the fiber-treatment composition of the present invention can be used in conjunction with silanolcondensation catalysts such as the salts of organic acids with metals such as zinc, tin, zirconium, etc., examples of which are zinc stearate, zinc oleate, dibutyltin diacetate, dibutyltin dioleate, dibutyltin dilaurate, and zirconium stearate; and with epoxy-curing agents such as amines, e.g., primary, secondary, and tertiary amines, dicarboxylic acids and their anhydrides, and zinc borofluoride.

The fiber-treatment composition of the present invention is applied by dissolving the organopolysiloxane under consideration in an organic solvent, e.g., toluene, xylene, benzene, n-hexane, heptane, acetone, methyl ethyl ketone, methyl isobutyl ketone, ethyl acetate, butyl acetate, mineral terpene, perchloroethylene, trichloroethylene, etc., or by emulsifying it using an appropriate emulsifying agent such as, for example, the salts of sulfate esters of higher alcohols, alkylbenzenesulfonate salts, higher alcohol-polyoxyalkylene adducts, alkylphenol-polyoxyalkylene adducts, higher fatty acid sorbitan esters, etc.

Fibrous material is treated with the fiber-treatment composition of the present invention using methods such as spraying, roll application, brush coating, immersion, etc. The add-on will vary with the type of birous material and thus cannot be specifically restricted; however, it typically falls within the range of 0.01 to 10.0 wt% as organopolysiloxane based on fibrous material. The fibrous material is then treated by allowing it to stand at room temperature, exposing it to a hot air current, heating, etc.

The fibrous material is exemplified in its substance by natural fibers such as wool, silk, flax, cotton, angora, mohair, and asbestos; by regenerated fibers such as rayon and Bemberg; by semisynthetic fibers such as acetate; by synthetic fibers such as polyester, polyamide, polyacrylonitrile, polyvinyl chloride, vinylon, polyethylene, polypropylene, and spandex; and by inorganic fiberes such as glass fiber, carbon fiber, and silicon carbide fiber; in its form by the staple, filament, tow, top, and yarn; and in its configuration by knits, weaves, nonwovens, and paper.

The invention is explained below with reference to illustrative examples. In the examples, parts=weight parts, %=weight %, and the viscosity is the value measured at 25 degrees Centigrade, unless specified otherwise.

EXAMPLE 1

Acetic acid, 0.8 parts, was added while mixing to 360 parts silanol-terminated dimethylpolysiloxane having a viscosity of 91 centistokes and a degree of polymerization of 40 and 40 parts gamma-glycidoxypropyltrimethoxysilane, followed by reaction at 120 to 130 degrees Centigrade under a nitrogen blanket for 4 hours to produce an epoxy-containing organopolysiloxane (viscosity=95.5 centistokes) having the following structural formula.

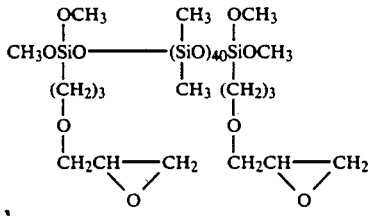

A treatment bath A was prepared by dissolving 1 part of this epoxy-containing organopolysiloxane and 0.05 parts dibutyltin dilaurate in 98.95 parts toluene. A 20 cm×40 cm specimen of twill (65% Tetoron/35% rayon, only fluorescent whitened) was immersed in treatment bath A for 10 seconds and then wrung out on wringing rolls to an expression ratio of 100% (1% organopolysiloxane add-on based on fabric). After standing for 3 hours at room temperature, the material was heated for 3 minutes at 150 degrees Centigrade. The treated material was divided in two specimens, and one of the organopolysiloxane-treated specimens was subjected to a total of three wash cycles in an automatic reversing washing machine. A wash cycle consisted of processing for one cycle under the conditions given below followed by two water rinses for 5 minutes.

Bath ratio: 1:50

Temperature: 40 degrees Centigrade

Detergent liquid: 0.5 aqueous solution of New White (from Lion Corporation)

Time: 50 minutes

The handle of the treated fabric was sensorially investigated both before and after washing. Furthermore, the % residual organopolysiloxane on the washed fabric was determined from the difference in the silicon atom count of the treated fabric before and after washing using a fluorescent X-ray analyzer from Rigaku Denki Kogyo Kabushiki Kaisha. These results are reported in Table 1.

COMPARISON EXAMPLE 1

A treatment bath B was prepared by dissolving 10 parts silanol-terminated dimethylpolysiloxane having a viscosity of 91 centistokes and a degree of polymerization of 40, 0.05 parts gamma-glycidoxypropyltrimethoxysilane, and 0.05 parts dibutyltin dilaurate in 98.9 parts toluene.

Treatment and evaluation were carried out by the methods of Example 1 using treatment bath B in place of treatment bath A, and these results are reported in Table 1.

COMPARISON EXAMPLE 2

A treatment bath C was prepared by dissolving to homogeniety 1 part organopolysiloxane (viscosity=150 centistokes) with the structural formula

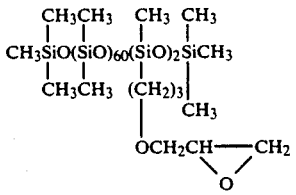

in 99 parts toluene.

Treatment and evaluation were carried out by the methods of Example 1 using treatment bath C in place of treatment bath A, and these results are reported in Table 1.

TABLE 1

| Reference | Treatment bath | Treated Fabric, pre-wash handle | Treated Fabric, post-wash handle | Treated Fabric, post-wash % residual organopolysiloxane |
|---|---|---|---|---|
| present invention | A | very good | good | 60.0 |
| | B | very inferior | very harsh | 35.5 |
| comparison examples | C | good | somewhat inferior | 45.3 |
| | blank | harsh | harsh | — |

EXAMPLE 2

Using a colloid mill, a stable emulsion was prepared from 40 parts organopolysiloxane (viscosity=68 centistokes) with having the general formula

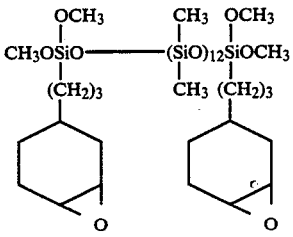

3.0 parts polyoxyethylene octylphenol ether (mixture of 3 types with HLB values of 10, 11, and 13), and 67 parts water. Ten grams of this emulsion was de-emulsified by the addition of 20 g isopropanol. The isopropanol solubles were then analyzed by gas chromatography: oligomer constituted 0.5% based on the total weight of organopolysiloxane in the emulsion.

Ten parts of this emulsion was combined with 290 parts water to prepare a treatment bath D, which had a 1% organopolysiloxane concentration. The pH was then adjusted to 10 using 10% aqueous sodium hydroxide. A 20 cm x 40 cm specimen of a 100% silk plain weave fabric for Occidentalstyle clothing was immersed in treatment bath D for 30 seconds, expressed to an expression ratio of 100% on a mangle, dried at room temperatured overnight, and then heated at 130 degrees Centigrade for 5 minutes. The treated fabric was divided in two, and one piece was subjected to a total of 5 wash cycles using an automatic reversing washer: one wash cycle consisted of a 10 minutes wash (using a 0.5% aqueous solution of Marseilles soap as the detergent liquid) followed by a 5 minutes water rinse. The flexibility was then evaluated according to JIS-L1096 - General Fabric Test Methods, Section 6.19 - Flexural Rigidity, Section 6.19.1-45 Degree Cantilever Method, and the wrinkle resistance was evaluated according to the same standard, Section 6.22-Wrinkle Resistance, Method B (Monsanto Method). The handle and % residual organopolysiloxane were measured according to the methods of Example 1. These results are reported in Table 2.

COMPARISON EXAMPLE 3

A treatment bath E was prepared as described in Example 2 using 40 parts organopolysiloxane (viscosity=61 centistokes) with the following structural formula

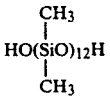

in place of the epoxy-containing organopolysiloxane. Treatment and evaluation were also carried out by the same methods, and these results are reported in Table 2.

COMPARISON EXAMPLE 4

Three parts dodecylbenzenesulfonic acid was dissolved to homogeneity in 55 parts water, and a separately prepared mixture of 40 parts octamethylcyclotetrasiloxane and 2 parts gamma-glycidoxypropyltrimethoxysilane was then added with stirring. This was passed twice through an homogenizer at 450 kg/cm$^2$, and the obtained emulsion was then heated at 80 degrees Centigrade for 2 hours, maintained at 10 degrees Centigrade overnight, and the neutralized with aqueous potassium hydroxide.

Ten grams of this emulsion was de-emulsified by the addition of 20 g isopropanol. The isopropanol solubles were analyzed by gas chromatography: the oligomer content was 13.2% based on the total weight of organopolysiloxane in the emulsion.

Water, 780 parts, was added to 20 parts of this emulsion to prepare a treatment bath F having an organopolysiloxane concentration of 1%. A 20 cm x 40 cm specimen of 100% silk plain weave fabric for Occidental-style clothing was immersed in treatment bath F for 30 seconds, expressed on a mangle to an expression ratio of 100%, dried at room temperature overnight, and then heated at 130 degrees Centigrade for 5 minutes.

The treated fabric was then washed (5 cycles) as in Example 2. The flexibility, wrinkle resistance, handle, and % residual organopolysiloxane were evaluated as in Example 2 for the treated fabric before and after washing, and these results are reported in Table 2.

TABLE 2

| item | present invention treatment bath D | comparison examples treatment bath E | treatment bath F | blank |
|---|---|---|---|---|
| PREWASH | | | | |
| wrinkle resistance (degrees) | 138.3 | 124.3 | 125.5 | 115.0 |
| flexural rigidity (mm) | 5.0 | 3.9 | 3.3 | 6.2 |
| handle | Good rebound. Silky handle almost completely retained. Suitable for Occidental-style clothing. Not slick | Very slick. Silky handle ruined. Unsuitable for Occidental-style clothing. | Extremely slick. Silky handle ruined. Unsuitable for Occidental-style clothing | Good silky handle, but easily wrinkled and the rebound is unsatisfactory. Unsuitable for Occidental-style clothing. |
| POSTWASH | | | | |
| wrinkle resistance (degrees) | 135.7 | 116.9 | 120.4 | 105.0 |
| flexural rigidity (mm) | 5.2 | 4.2 | 3.8 | 5.7 |
| handle | Handle as above is retained (even after 5 wash cycles). Washable as Occidental-style clothing. Difficult to wrinkle. | Slickness remains. Unsuitable for Occidental-style clothing. Very slippery. | Slickness remains high. Unsuitable for Occidental-style clothing. Very slippery. | Very wrinkled. Unsuitable for Occidental-style silk clothing. |
| % residual organopolysiloxane | 55.2 | 20.3 | 30.8 | — |

EXAMPLE 3

An organopolysiloxane, 0.8 parts, (viscosity = 65 centistokes) with the following structural formula

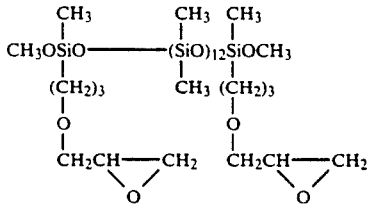

and 0.03 parts dibutyltin diacetate as catalyst were dissolved in 30 parts perchloroethylene to prepare a treatment liquid.

Using a simple spray gun, this treatment liquid was uniformly sprayed on 100 g of cottom quilt fill which had been spread using a hand card. This was then dried at room temperature and heated at 150 degrees Centigrade for 5 minutes. The obtained cotton fill was then divided into two portions, and one portion was placed into a small quilt (20 cm×20 cm) prepared using 100% cotton broadcloth as the casing. After washing for 5 cycles under the conditions of Example 2, the fill was removed form the quilt and dried. The feel of the cotton quilt fill was examined both before and after washing: there was almost no difference in handle between before and after washing, and the finished material had a feathery feel and high compression recover. As a consequence, this treatment composition was entirely suitable for the treatment of cotton quilt fill.

EFFECTS OF THE INVENTION

The fiber-treatment composition of the present invention characteristically can impart a durable flexibility and softness, smoothness, and rebound to fibrous material, and, because it contains little oligomer fraction, will not cause oligomer-derived oil staining during fiber treatment That which is claimed is:

1. A fiber-treatment composition consisting essentially of an epoxy group-containing organopolysiloxane with the general structural formula

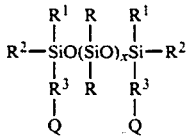

wherein R is a monovalent hydrocarbon radical, $R^1$ is an alkoxy radical, $R^2$ is an R or $R^1$ radical, $R^3$ is a divalent hydrocarbon radical, Q is a radical having the formula

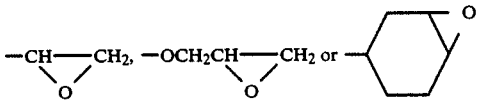
and x is an integer with a value of at least 5 and a component selected from the group consisting of a silanol-condensing catalyst and an epoxy-curing agent.
2. A composition in accordance with claim 1 wherein R is methyl and $R^1$ is methoxy.
3. A composition in accordance with claim 1 wherein the epoxy group-containing organopolysiloxane is emulsified in water.
* * * * *